US005745956A

United States Patent [19]

Patelli et al.

[11] Patent Number: 5,745,956

[45] Date of Patent: May 5, 1998

[54] AUTOMATIC DEVICE FOR REGULATING AND MONITORING THE TENSION OF THE SILVER TRANSFERRED FROM THE DRAFTING UNIT OF A CARD TO THE SILVER COLLECTION UNIT

[75] Inventors: Silvano Patelli; Antonio Cossandi; Giovanni Battista Pasini, all of Palazzolo Sull'Oglio, Italy

[73] Assignee: F.LLI Marzoli & C. S.p.A., Bergamo, Italy

[21] Appl. No.: 731,619

[22] Filed: Oct. 16, 1996

[30] Foreign Application Priority Data

Oct. 16, 1995 [IT] Italy ..... MI95A2121

[51] Int. Cl.[6] ..... D01G 23/06

[52] U.S. Cl. ..... 19/106 R; 19/157; 19/159 R

[58] Field of Search ..... 19/0.2, 0.21, 0.22, 19/0.25, 0.35, 106 R, 239, 287, 288, 157, 159 R, 150; 73/159, 160; 112/278, 254, 302

[56] References Cited

U.S. PATENT DOCUMENTS

| | | | |
|---|---|---|---|
| 3,251,093 | 5/1966 | Maynard et al. | 19/0.25 |
| 3,310,844 | 3/1967 | Robertson | 19/0.25 |
| 3,363,285 | 1/1968 | Foster | 19/0.25 |
| 3,602,727 | 8/1971 | Schwalm et al. | 19/0.21 |
| 3,965,401 | 6/1976 | Jones, Jr. et al. | 19/106 R |
| 4,027,358 | 6/1977 | Llach et al. | 19/106 R |
| 4,065,831 | 1/1978 | Huntsinger | 19/0.25 |
| 4,095,062 | 6/1978 | Savageau | 19/0.25 |
| 4,982,477 | 1/1991 | Hosel . | |
| 5,018,246 | 5/1991 | Leifeld . | |

FOREIGN PATENT DOCUMENTS

| | | |
|---|---|---|
| 0312774 | 9/1988 | European Pat. Off. . |
| 3834110 | 10/1988 | European Pat. Off. . |
| 3913548 | 4/1989 | European Pat. Off. . |
| 61-275427 | 5/1987 | Japan . |

*Primary Examiner*—Michael A. Neas
*Attorney, Agent, or Firm*—Diller, Ramik & Wight

[57] ABSTRACT

A device for monitoring and regulating the tension in the sliver produced by a carding unit and transferred from this along a path to a unit for its collection into cans for further processing, comprising a deviator bar pivoted on a pivot and an oppositely located rod provided with an element which opposes the rotary movement of the bar deriving from the variations in tension of the sliver deviated by it, the sliver tension being measured by sensors on the basis of the effect induced by the sliver on the bar, the relative signals being transmitted to the control unit which compares the values received with the allowable limiting values and implements the consequent interventions.

7 Claims, 2 Drawing Sheets

AUTOMATIC DEVICE FOR REGULATING AND MONITORING THE TENSION OF THE SILVER TRANSFERRED FROM THE DRAFTING UNIT OF A CARD TO THE SILVER COLLECTION UNIT

BACKGROUND OF THE INVENTION

This invention relates to cards in which fibrous material in the form of a thin layer is processed by a series of surfaces driven to move relative to each other and provided with a plurality of points of various shapes, inclination and rigidity, in which the fibrous material is opened into individual fibres, the impurities and trash are removed, and the fibres are mixed together to form a fibre sliver which is collected in large cans to be fed to the subsequent processing stages.

SUMMARY OF THE INVENTION

The present invention relates in particular to the transfer of the sliver from the carding unit to the device for packaging the sliver in the collection can.

DESCRIPTION OF THE PREFERRED EMBODIMENTS

Figure 1:
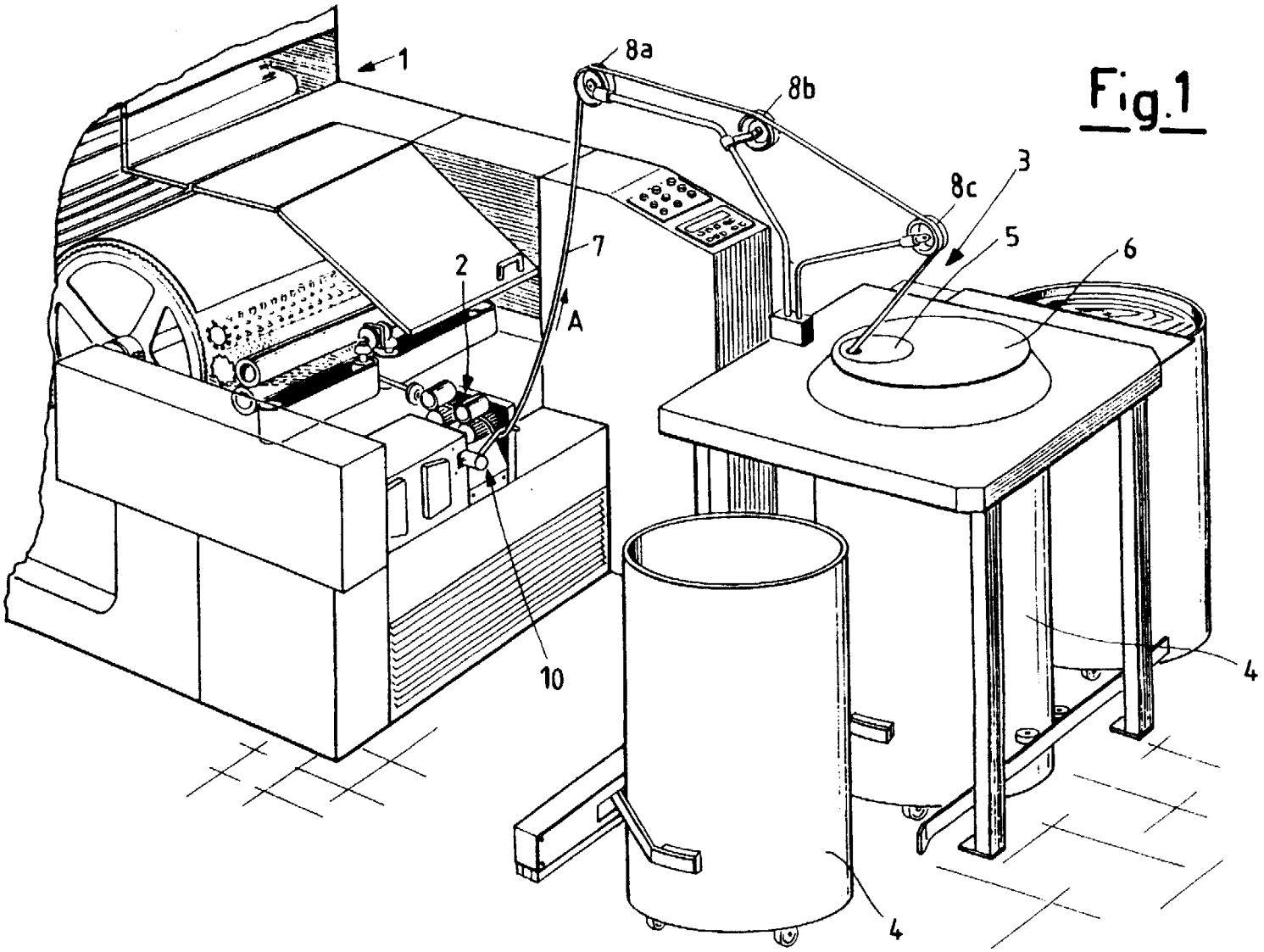
FIG. 1 is a fragmentary perspective view of a carding unit, and illustrates a device for monitoring and regulating the tension of a sliver including a pivotal bar 11 beneath which the sliver passes and a sensor for detecting the rotary movement of the bar which is reflective of the tension of the sliver.

In the carding unit 1 the fibres separated and mixed together in the carding operation are formed into a web having sufficient consistency to be drawn through a condenser by a roller unit 2, also known as a drafting unit. This sliver is fed to the collection unit 3 which pulls it from the carding unit by means of two rollers (not shown in the figure) and packages it into cans 4 by means of a rotary distributor plate which deposits it inside the can in the form of superposed turns. The rotary distributor 5 is eccentric to its support plate 6 which lies above the can 4 being filled. Collecting the sliver in cans for its feed to subsequent processes means that carding is independent of the subsequent operations.

The sliver produced by carding has a low resistance to traction and must be adequately processed. For this, its packaging in cans as superposed spirals enables it to be subsequently extracted without generating tensions which cannot be withstood by virtue of the low strength of the sliver. For correct transfer of the sliver between the two units, the linear speed with which it leaves the roller unit 2 of the carding unit must be slightly less than that with which it is drawn by the rollers located in the unit by which it is collected in the can 4, so producing a slight drafting effect.

The present invention relates specifically to the control of this transfer and in particular to the monitoring and regulation of the tension generated in the sliver by the two roller units in sequence.

In the known art the sliver is generally monitored by a normal yarn feeler which senses the presence or absence of the sliver, ie its continuity or its breakage, in this latter case it causing stoppage of the card/collection assembly. In this respect it represents a production loss and requires the sliver continuity to be restored by the action of the operator.

The object of the present invention is the preventive monitoring of the sliver tension, in order to be able to act to correct any tension excesses or deficiencies before they give rise to breakages or other problems. Such unbalance can be a symptom not only of mere operational inaccuracy of the rollers but can also indicate more complicated problems, which merit timely preventive action.

To illustrate with greater clarity the characteristics and advantages of the present invention, a typical embodiment thereof is described hereinafter with reference to FIGS. 1 and 2, by way of non-limiting example.

Figure 2:
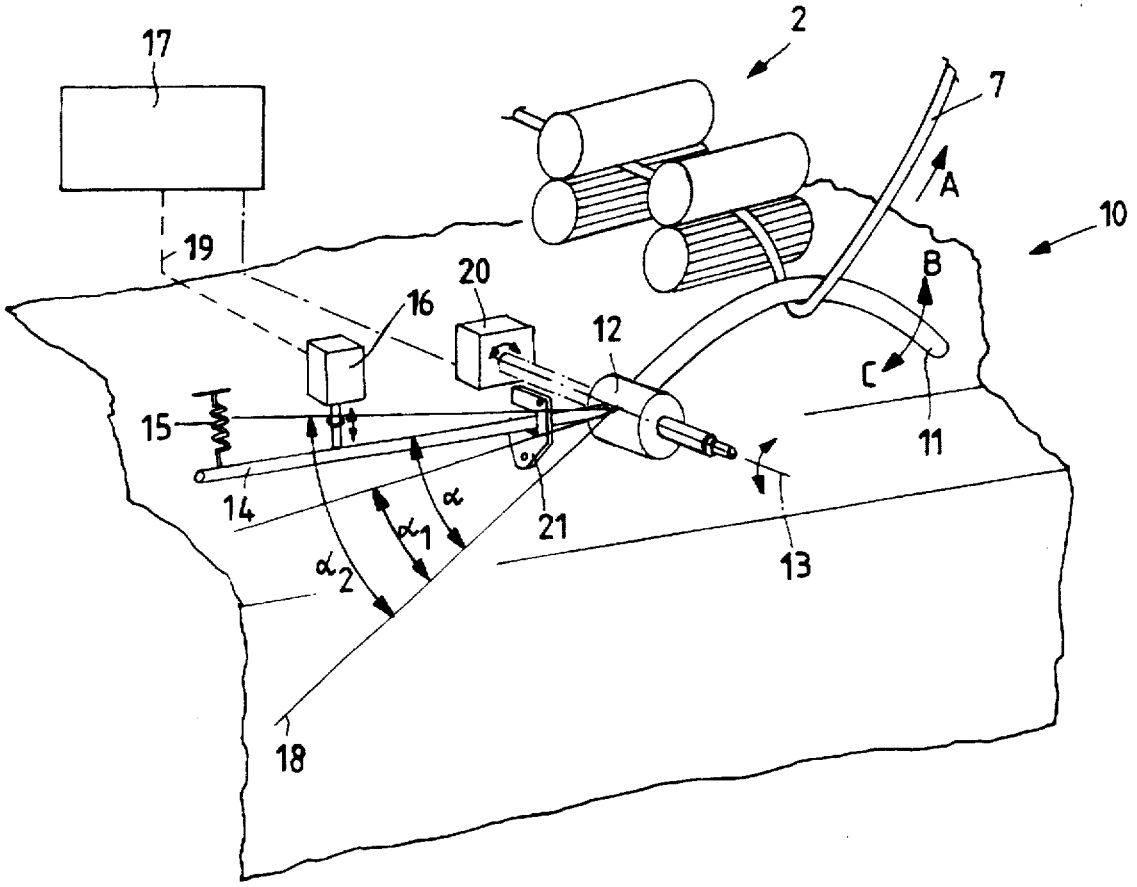
FIG. 2 is a fragmentary enlarged view of the sliver tension monitoring and regulating device, and illustrates details thereof.

The sliver tension monitoring device 10, which constitutes a very important characteristic of the present invention and is described hereinafter with reference to the enlarged view of FIG. 2, is positioned at the exit of the rollers 2 of the carding unit 1 along the path of the sliver 7 towards the guide pulleys 8*a*, *b*, *c* of the collection unit 3.

The device 10 consists of an arched bar 11 of rounded cross-section enabling the sliver to travel in a direction transverse to it in moving in accordance with the arrow A from the rollers 2 to the pulleys 8, and pivoted on the pivot 12 to rotate about its axis 13. The sliver 7 is deviated by the deviating bar 11 in its path towards 8 to form a loop the width of which depends on its tension. A rod 14 is positioned on the opposite side of the pivot 12 to the arched bar 11 in a manner coplanar with this latter, to undergo rotational movements into positions indicated by the angle $\alpha$ and coherent with the corresponding movements of the bar 11. Said bar 11 and the rod 14 hence form a two-armed lever pivoted at 12. At the opposite end to the bar 11, the rod 14 is provided with an opposition spring 15 which provides a resistance to its movement deriving from the action of the sliver, to an extent based on its elastic characteristic. The rod 14 can also be provided with counterweights, not shown in FIG. 2, which are slidable and fixable along it in order to preset the bar/rod rocker assembly at values determined by its rotary momentum. The rotational movements of said rod 14 are measured by the position sensor 16, for example a transducer generating a signal corresponding to the angular position $\alpha$ which the rod 14, combined with the bar 11, assumes on the basis of the tension of the sliver 7. It is apparent that an increase in the sliver tension results in the bar 11 rising by rotating anticlockwise in the direction of the arrow B, whereas a decrease in the sliver tension results in the bar 11 lowering by rotating clockwise in the direction of the arrow C.

The sensor 16 is connected to the control unit 17 for the overall carding and collection machine and receives from it the limiting values of the angle $\alpha$, for example $\alpha 1$ and $\alpha 2$ measured with respect to a reference line 18 preferably lying in the rotational plane of the rod 14 and passing through the intersection of the axis 13 with said plane, these angles corresponding to the maximum and minimum allowable tension for the sliver. The connection line 19 is used to transmit the relevant data in real time.

According to a modified embodiment of the present invention, the sensor 16 for measuring the angular deviation of the sliver can be replaced by a sensor for measuring the angular momentum generated on the pivot 12, for instance on a transducer 20 which generates a signal corresponding to the torsional angular momentum $\tau$ generated by the sliver 7 under tension deviated about the bar 11, which must be monitored and remain for example between limiting values $\tau 1$ and $\tau 2$ corresponding to the maximum and minimum allowable tension for the sliver. In all cases the sliver tension is measured by sensors on the basis of the effect induced by this on the bar 11 in the direction of rotation indicated by the arrows B and C.

The signals generated by said sensors are transmitted to the control unit 17, which continuously compares the received values with the allowable limiting values which have been fed into it, for example angular position $\alpha$ or angular momentum $\tau$ values, and corresponding to the maximum and minimum allowable sliver tension in its portion 7. Said control unit is provided with intervention means to consequently implement the necessary actions. For example, if these values are outside the range of allowable values, it halts the carding/collection machine, to allow adjustment and inspection before the sliver breaks. Alternately, it could change the speed of the collection unit to adapt it to the carding rate, within the limits of an allowable adjustment range.

At the rod 14 there is provided a rod stop fork 21, to be mounted during a controlled halt of the machine, after which the sliver transfer by the rollers ceases, its tension falls and the signal generated by the connected sensor loses significance.

The monitoring device according to the present invention can also be used as a yarn feeler to sense the presence of sliver along the path 7. Sliver breakage results in the sliver tension dropping to zero, which is obviously outside the range of allowable values. It is also advantageous because of its attenuation effect on any sliver movement irregularities, provided the tension remains within the allowable tension range during these. The loop in the path 7 at the bar 11 forms a "reserve" of sliver to be accumulated and returned during these irregularities. A further advantage of the present invention is the effect of making the sliver can collection unit geometrically independent of the carding unit. In this respect it can be located in the most convenient position relative to the carding unit for any given case, as the tension along the free portion of the sliver is monitored. The collection unit can also be easily moved from one carding unit to another.

Although a preferred embodiment of the invention has been specifically illustrated and described herein, it is to be understood that minor variations may be made in the apparatus without departing from the spirit and scope of the invention, as defined the appended claims.

We claim:

1. A device for monitoring and regulating the tension in the sliver produced by a carding unit and transferred from this along a path (7) to a unit for its collection into cans for further processing, comprising a deviator bar (11) pivoted on a pivot (12) and an oppositely located rod (14) provided with means which oppose the rotary movement of the bar (11) deriving from the variations in tension of the sliver (7) deviated by it, characterised in that the sliver tension is measured by sensors on the basis of the effect induced by the sliver on the bar (11), the relative signals being transmitted to the control unit (17) which compares the values received with the allowable limiting values.

2. A device for monitoring and regulating the tension in the sliver produced by a carding unit and transferred from this to a unit for collection into cans as claimed in claim 1, characterised in that the means which oppose the rotary movement of the bar (11) deriving from the variations in the tension of the sliver (7) deviated by it consist of a counter-acting spring (15).

3. A device for monitoring and regulating the tension in the sliver produced by a carding unit and transferred from this to a unit for collection into cans as claimed in claim 1, characterised in that the effect of the tension variations in the sliver (7) is measured by a sensor for measuring the angular position ($\alpha$) which the rod (14) assumes based on the tension in the sliver (7).

4. A device for monitoring and regulating the tension in the sliver produced by a carding unit and transferred from this to a unit for collection into cans as claimed in claim 3, characterised in that the sensor for measuring the angular position ($\alpha$) consists of a transducer (16) which generates a signal corresponding to said position.

5. A device for monitoring and regulating the tension in the sliver produced by a carding unit and transferred from this to a unit for collection into cans as claimed in claim 1, characterised in that the effect of the tension variations in the sliver (7) is measured by a sensor for measuring the angular momentum ($\tau$) generated on the pivot (12).

6. A device for monitoring and regulating the tension in the sliver produced by a carding unit and transferred from this to a unit for collection into cans as claimed in claim 5, characterised in that the sensor for measuring the angular momentum generated on the pivot (12) consists of a transducer (20) which generates a signal corresponding to said angular momentum.

7. A device for monitoring and regulating the tension in the sliver produced by a carding unit and transferred from this to a unit for collection into cans as claimed in claim 1, characterised in that the control unit (17) is provided with intervention means for halting the carding/collection machine before sliver breakage.

* * * * *